US009506345B2

(12) United States Patent
Vogel et al.

(10) Patent No.: US 9,506,345 B2
(45) Date of Patent: Nov. 29, 2016

(54) METHOD OF OPERATING A ROCK BOLTING MACHINE

(71) Applicant: BRANDT ENGINEERED PRODUCTS LTD., Regina Saskatchewan (CA)

(72) Inventors: Travis Vogel, Regina Saskatchewan (CA); Michael Pletz, Cupar Saskatchewan (CA); Rick Copeland, Beuna Vista SK (CA); Dan Bonnet, Regina Saskatchewan (CA)

(73) Assignee: BRANDT ENGINEERED PRODUCTS LTD., Saskatchewan (CA)

( * ) Notice: Subject to any disclaimer, the term of this patent is extended or adjusted under 35 U.S.C. 154(b) by 0 days.

(21) Appl. No.: 14/582,962

(22) Filed: Dec. 24, 2014

(65) Prior Publication Data

US 2015/0218947 A1 Aug. 6, 2015

(30) Foreign Application Priority Data

Feb. 4, 2014 (CA) ..... 2841506
Feb. 4, 2014 (CA) ..... 2841582
Oct. 6, 2014 (CA) ..... 2866044

(51) Int. Cl.
*E21D 20/00* (2006.01)
*E02D 5/80* (2006.01)
*E21D 21/00* (2006.01)

(52) U.S. Cl.
CPC ..... *E21D 20/003* (2013.01); *E02D 5/801* (2013.01); *E21D 21/00* (2013.01)

(58) Field of Classification Search
CPC ... E21D 20/003; E21D 20/006; E21D 21/00; E21D 21/008; E21D 21/02
See application file for complete search history.

(56) References Cited

U.S. PATENT DOCUMENTS 3,385,155 A * 5/1968 Michell ..... E21D 21/008 405/302.1
3,979,944 A 9/1976 Salmi et al.
4,023,626 A 5/1977 Salmi et al.
4,226,559 A * 10/1980 Prebensen ..... E21B 7/025 173/184
4,300,397 A * 11/1981 Brest van Kempen ..... E21B 49/006 73/761
4,352,600 A * 10/1982 Brest van Kempen . E21D 21/02 405/259.1
4,444,530 A * 4/1984 Brest van Kempen . E21D 21/02 173/20
4,759,888 A * 7/1988 Brest van Kempen . E21D 20/02 264/35

(Continued)

FOREIGN PATENT DOCUMENTS

JP 11-173063 12/1997

*Primary Examiner* — Benjamin Fiorello
*Assistant Examiner* — Aaron Lembo
(74) *Attorney, Agent, or Firm* — Nixon & Vanderhye P.C.

(57) ABSTRACT

A method of installing a rock bolt is provided. A bolt hole can be formed by applying an insertion force to a drill rod and while the insertion force is being applied, applying a rotational force on the drill rod to rotate the drill rod and bore the bolt hole. A rock bolt can then be installed in the bolt hole by applying an insertion force to the rock bolt to insert the rock bolt into a bolt hole and while the insertion force is applied to the rock bolt, applying a rotational force on the rock bolt to rotate the rock bolt in the bolt hole. As the rotational force being applied to the rock bolt increases, the insertion force applied to the rock bolt can be decreased until no insertion force is being applied and the rock bolt has been torqued to a desired torque amount.

20 Claims, 7 Drawing Sheets

(56) References Cited

U.S. PATENT DOCUMENTS 5,114,279 A * 5/1992 Bjerngren ..... E21D 20/006 405/259.1
5,303,787 A 4/1994 Brady
5,824,912 A * 10/1998 Stankus ..... E21C 39/00 405/133
6,685,876 B1 2/2004 Murata et al.
6,732,813 B1 5/2004 Eklof
6,793,445 B1 * 9/2004 Charlton ..... E21D 20/003 405/259.1
6,883,620 B1 4/2005 Cadet
6,938,702 B2 9/2005 Saha et al.
8,091,652 B2 1/2012 Sinnerstad et al.
8,109,156 B2 * 2/2012 Schmeisser ..... G01L 3/04 73/862.08
2002/0030398 A1 * 3/2002 Drake ..... E21B 7/002 299/8
2004/0136788 A1 * 7/2004 Hindle ..... E21D 21/0026 405/259.1
2006/0278414 A1 * 12/2006 Oberg ..... E21B 17/0426 173/1
2008/0093525 A1 * 4/2008 Saf ..... E21B 7/028 248/674
2009/0016823 A1 * 1/2009 Oberg ..... E21D 20/003 405/259.3
2011/0036634 A1 * 2/2011 Nystrom ..... E21B 7/025 175/113
2011/0048808 A1 * 3/2011 Nystrom ..... E21B 7/025 175/203
2011/0147084 A1 6/2011 Sinnerstad et al.
2011/0182672 A1 * 7/2011 Nystrom ..... E21D 20/028 405/259.5

* cited by examiner

METHOD OF OPERATING A ROCK BOLTING MACHINE

CROSS REFERENCE TO RELATED APPLICATION

This application claims priority to Canada Application 2841506, filed on Feb. 4, 2014; Canada Application No. 2841582, filed on Feb. 4, 2014; and Canada Application No. 2866044, filed on Oct. 6, 2014, the entire contents of each of which are herein incorporated by reference.

The present invention relates to a method of drilling a bolt hole and torqueing a rock bolt to a desired torque with a rock bolting machine.

BACKGROUND

Rock bolts are installed in the roofs of mines, tunnels and other underground spaces for securing the roof of the mine in place and preventing the roof from collapsing when the mine is in use and workers may be in the mine. Typically, a bolt hole is drilled in the mine roof and then a rock bolt is secured in the drilled bolt hole.

It is common for the rock bolts to be installed by using a vehicle with a rock bolting apparatus attached to a boom. The rock bolting apparatus can be raised or lowered using the boom so that the rock bolting apparatus can come into contact with the roof of the mine to drill a bolt hole and install a rock bolt in the drilled bolt hole. The purpose of the boom is to position the rock bolting apparatus well out in front of the vehicle so that the vehicle and the operator of the vehicle can remain under a portion of the mine roof that has already been rock bolted and secured.

Once a bolt hole is drilled in the mine roof, a rock bolt has to be installed in the bolt hole. The rock bolt is typically inserted into the bolt hole and torqued to try and achieve a desired amount of torque on the rock bolt.

SUMMARY OF THE INVENTION

In one aspect, a method of installing a rock bolt is provided. The method can include applying an insertion force to the rock bolt to insert the rock bolt into a bolt hole and while the insertion force is applied to the rock bolt, applying a rotational force on the rock bolt to rotate the rock bolt in the bolt hole. As the rotational force being applied to the rock bolt increases, the insertion force applied to the rock bolt is decreased.

In a further aspect, the bolt hole is formed by applying an insertion force to a drill rod and while the insertion force is being applied to the drill rod, applying a rotational force on the drill rod to rotate the drill rod and bore the bolt hole. When the rotational force being applied to the drill rod increases above a drill rotational force level, the insertion force applied to the drill rod is decreased. When the rotational force being applied to the drill rod decreases below the drill rotational force level, the insertion force applied to the drill rod is increased.

In another aspect, a rock bolting apparatus for installing a rock bolt in a bolt hole is provided. The rock bolting apparatus can include a bolting portion adapted for installing the rock bolt in the bolt hole. The bolting portion can include a bolt feed motor operatively connected to the rock bolt to apply an insertion force to the rock bolt to insert the rock bolt in the bolt hole and a bolt rotation motor operatively connected to the rock bolt to apply rotational force to the rock bolt. The rock bolting apparatus can also include a controller operative to determine the rotational force being applied to the rock bolt by the bolt rotation motor and decrease the insertion force applied to the rock bolt by the bolt feed motor as the rotational force being applied to the rock bolt by the bolt rotation motor increases.

In a further aspect, the rock bolting apparatus can further include a drilling portion adapted for drilling the bolt hole before the drilling portion installs the rock bolt in the bolt hole. The drilling portion can include a drill feed motor operatively connected to a drill rod to apply an insertion force to the drill rod and a drill rotation motor operatively connected to the drill to apply a rotational force to the drill rod.

In an even further aspect, the controller can be further operative to determine the rotational force being applied to the drill rod by the drill rotation motor. When the rotational force being applied to the drill rod increases above a drill rotational force level, the controller can decrease the insertion force applied to the drill rod by the drill feed motor. When the rotational force being applied to the drill rod decreases below the drill rotational force level, the controller can increase the insertion force applied to the drill rod by the drill feed motor.

DESCRIPTION OF THE DRAWINGS

An embodiment of the present invention is described below with reference to the accompanying drawings, in which.

DETAILED DESCRIPTION OF THE ILLUSTRATED EMBODIMENTS

Figure 1:
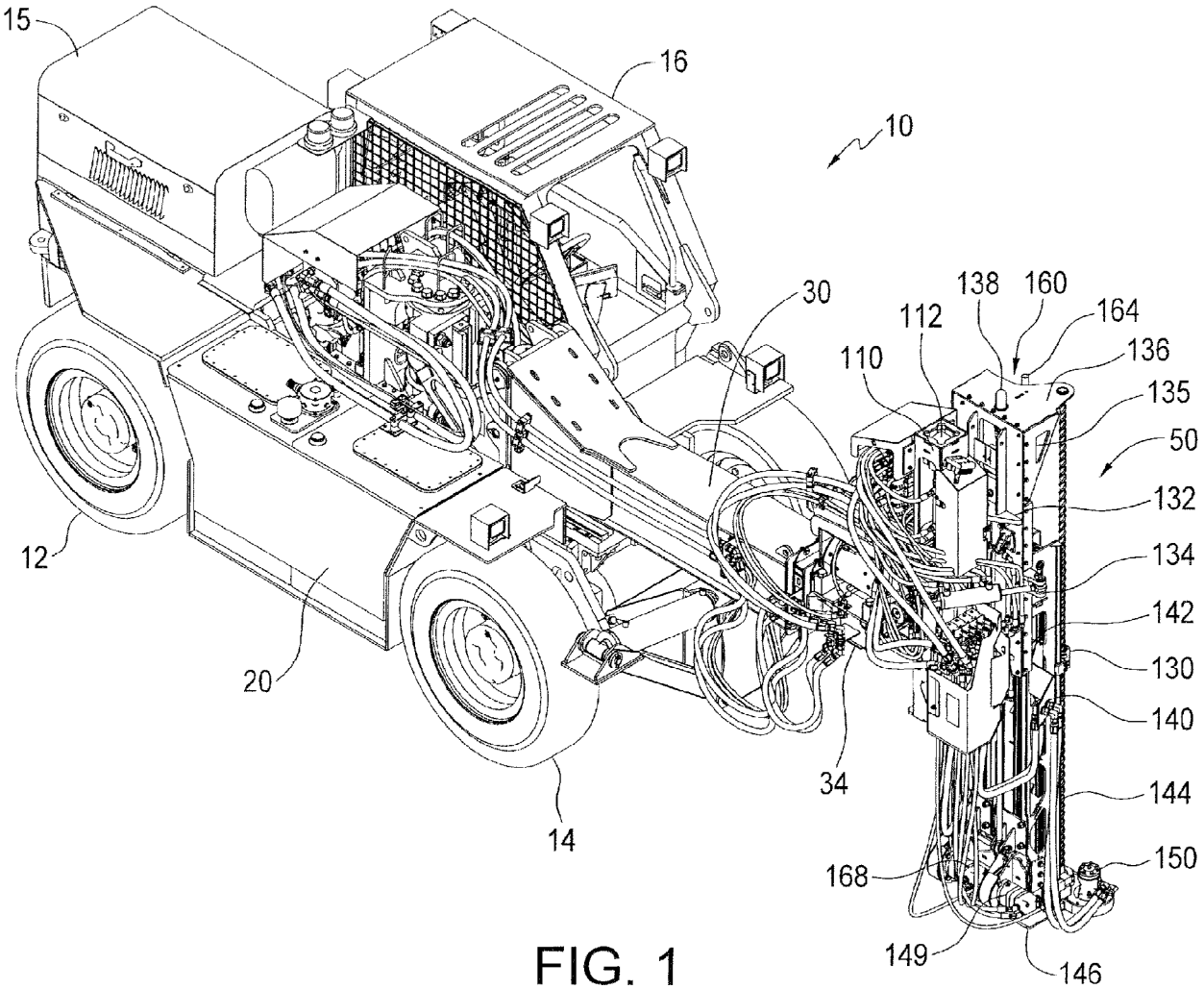
FIG. 1 is a perspective view of a rock bolting machine.

FIG. 1 illustrates a rock bolting machine 10 that is used to travel in a mine or other underground space and install rock bolts in the roof of the underground space. The rock bolting machine 10 can comprise a vehicle 20 and a rock bolting apparatus 50 connected to the vehicle 20 by a boom 30. The boom 30 can be attached to a rock bolting apparatus 50 so that the boom 30 positions the rock bolting apparatus 50 out in front of the vehicle 20. An operator can maneuver the rock bolting machine 10 so that the rock bolting apparatus 50 is positioned under a spot on the roof of the underground chamber where a rock bolt is going to be installed and then the rock bolting apparatus 50 can be placed against the roof of the underground space using the boom 30 and the rock bolting apparatus 50 used to first drill a bolt hole for a rock bolt and then install a rock bolt in the drilled bolt hole. By using the boom 30 to position the rock bolting apparatus 50 well out in front of the vehicle 20, the vehicle 20 can be operated under a portion of the roof in the underground space that has already been rock bolted.

The vehicle 20 can have a pair of rear wheels 12, a pair of front wheels 14 and an engine 15 so that the vehicle 20 is self-propelled. A cab 16 can be provided on the vehicle 20 so that an operator can sit in the cab 16 and operate the rock bolting machine 10. In one aspect, the vehicle 20 can be hydraulic powered to drive the rear wheels 12, the front wheels 14 or both the rear wheels 12 and the front wheels 14. The hydraulics can also be used to operate the boom 30 and the rock bolting apparatus 50.

Figure 2:
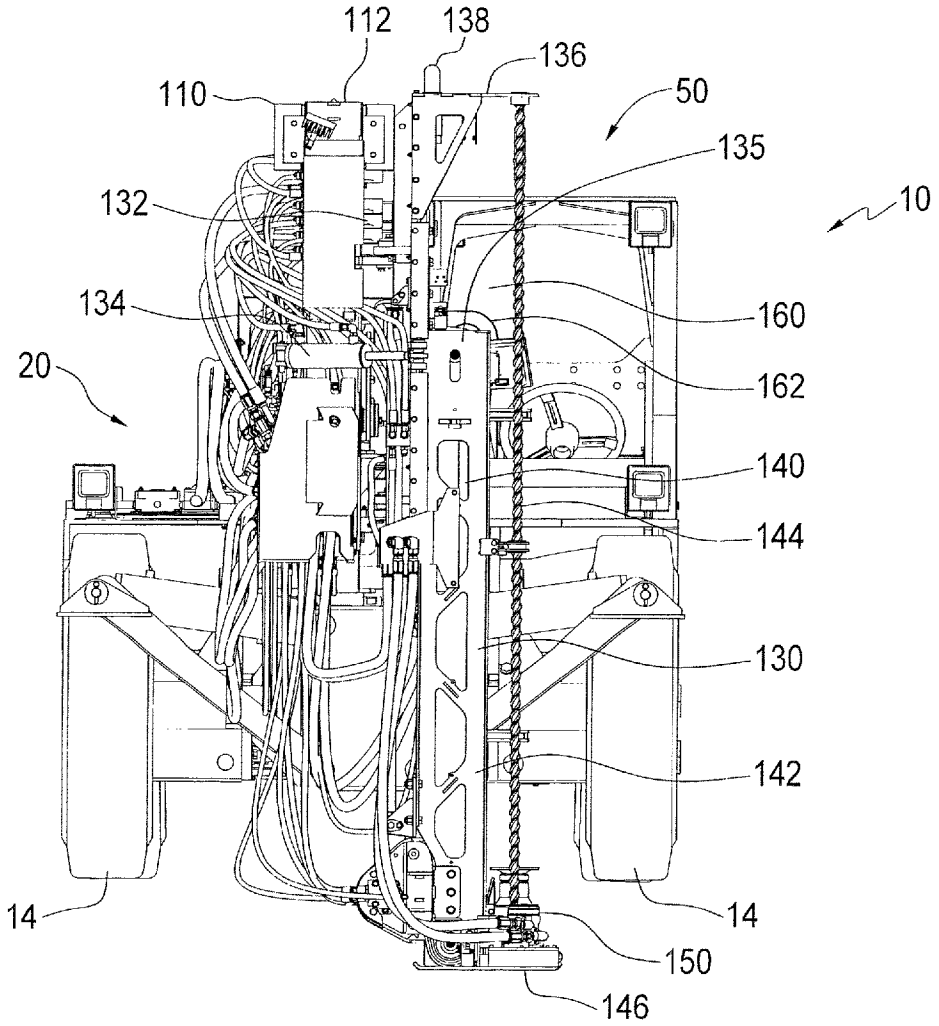
FIG. 2 is a front view of the rock bolting machine of FIG. 1.
Figure 3:
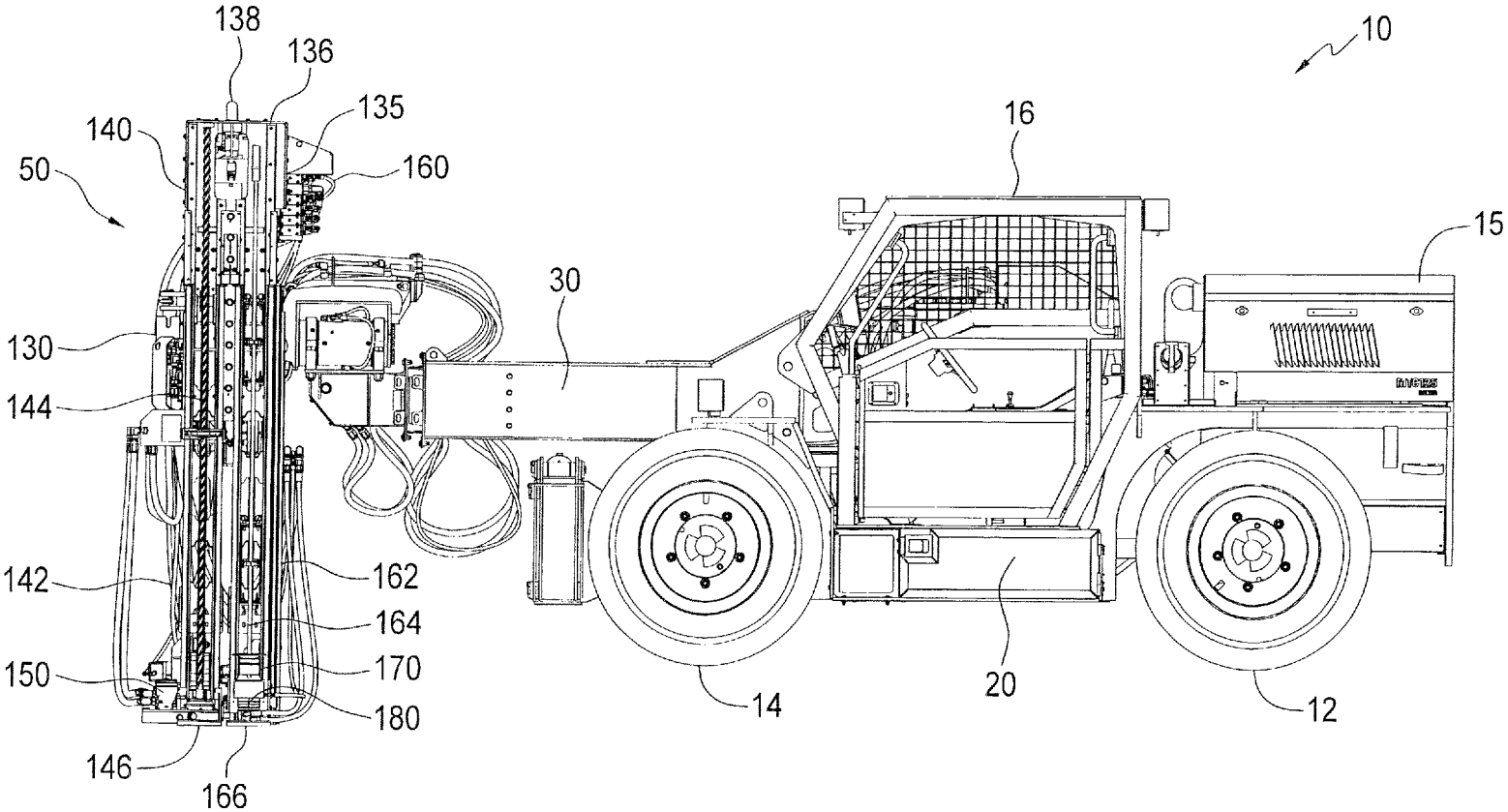
FIG. 3 is a side view of the rock bolting machine of FIG. 1.

FIGS. 2 and 3 illustrate the rock bolting apparatus 50 operatively connected to a distal end 34 of the boom 30 that can be used to both drill a bolt hole and then install a rock bolt in the bolt hole. The rock bolting apparatus 50 can include a pick mast 110 and a drill bolt mast 130. Referring to FIGS. 1-3, the pick mast 110 can be operatively connected to the distal end 34 of the boom 30.

The drill bolt mast 130 can be pivotally connected by a pivot point 132 to the pick mast 110 so that the drill bolt mast 130 can be rotated around this pivot point 132 while the pick mast 110 remains stationary. An actuator 134 can be positioned between the pick mast 110 and the drill bolt mast 130 to rotate the drill bolt mast 130 around the pivot point 132. In one aspect, the actuator 134 can be a hydraulic cylinder.

The drill bolt mast 130 can have a frame 135 with a top plate 136 and a nub 138 extending upwards above the top plate 136. The nub 138 can be forcibly retracted downwards toward the top plate 136 and is connected to a switch to stop the boom 30 from continuing to move the rock bolt apparatus 50 after the nub 138 has been depressed. In this manner, when the nub 138 is depressed the rock bolt apparatus 50 and specifically the top plate 136 of the drill bolt mast 130 is against the roof of the underground space.

The drill bolt mast 130 can include a drilling portion 140 and a bolting portion 160. The drilling portion 140 is used to first drill a bolt hole in the roof of the underground space. When the bolt hole has been drilled, the drill bolt mast 130 can then be rotated around the pivot point 132 until the bolting portion 160 lines up with the bolt hole and the bolting portion 160 used to install a rock bolt in the bolt hole.

The drilling portion 140 can have a drill guide frame 142 that can be moved vertically relative to the frame 135 of the drill bolt mast 130 as well as guide a drill rod 144 that can be moved vertically relative to the drill guide frame 142 as the drill rod 144 is rotated and moved upwards relative to the drill guide frame 142. The drill guide frame 142 can extend vertically and be movable so that a top end of the drill guide frame 142 can be positioned against the top plate 136 of the drill bolt mast 130 or moved downwards to create a space between the top of the drill guide frame 142 and bottom of the top plate 136.

A foot plate 146 can be provided on the bottom of the drill guide frame 142 to protect the elements of the drilling portion 140 from being damaged if the bottom of the drilling portion 140 accidentally comes into contact with the floor of the underground chamber while the rock bolting apparatus 50 is being maneuvered into place.

The drilling portion 140 can both rotate the drill rod 144 and move the drill rod 144 upwards relative to the drill guide frame 142 and the frame 135 of the drill bolt mast 130 to drill a bolt hole where the rock bolt will be installed.

The bolting portion 160 of the rock bolting apparatus 50 is used to fasten a rock bolt 164 into the bolt hole that has been created by the drilling portion 140. The bolting portion 160 can have a bolting guide frame 162 that allows a bolting assembly 170 to move vertically along bolting guide frame 162. The bolting guide frame 162 can extend vertically and be movable vertically relative to the frame 135 of the drill bolt mast 130 so that a top end of the bolting guide frame 162 can be positioned against the top plate 136 of the drill bolt mast 130 or moved downwards to create a space between the top of the bolting guide frame 162 and bottom of the top plate 136 of the drill bolt mast 130.

A foot plate 166 can be provided on the bottom of the bolting guide frame 162 to protect the elements of the bolting portion 160 from being damaged if the bottom of the bolting portion 160 accidentally comes into contact with the floor of the underground space while the rock bolting apparatus 50 is being maneuvered into place.

Figure 4:
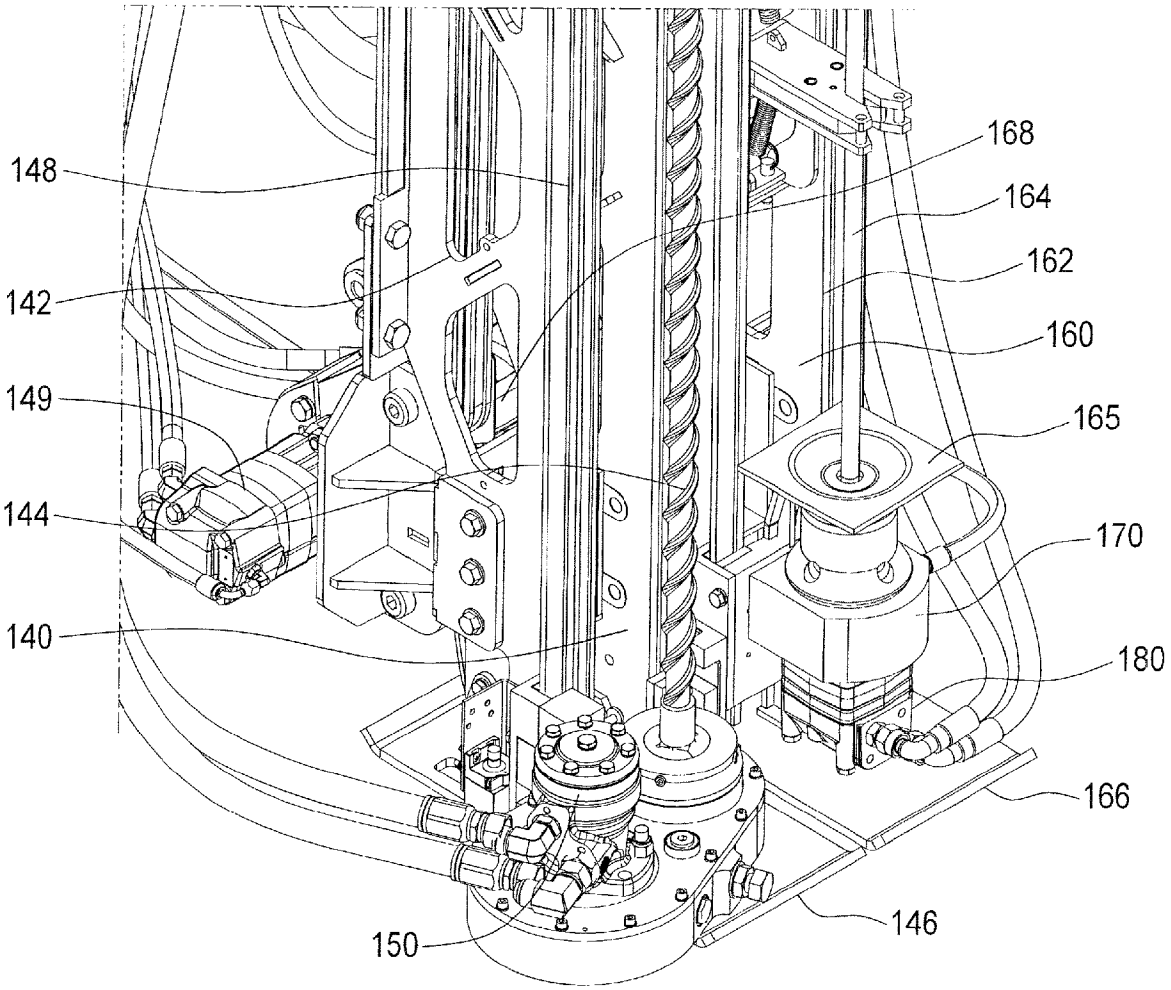
FIG. 4 is a close up view of a distal end of a boom on the rock bolting machine.

The bolting portion 160 can both rotate or torque the rock bolt 164 and move the rock bolt 164 upwards relative to the bolting guide frame 162 and the frame 135 of the drill bolt mast 130 to insert the rock bolt 164 in the bolt hole drilled by the drilling portion 140 of the drill bolt mast 130. FIG. 4 illustrates a close up view of the bottom of the drilling portion 140 and the bolting portion 160. A drill rotation motor 150 can be provided for rotating the drill rod 144 in the drilling portion 140 and a drill feed motor 149 can be provided for moving the drilling portion 140 and the drill rod 144 upwards.

A bolt rotation motor 180 can be provided for torqueing or rotating the rock bolt in the bolting portion 160. This bolt rotation motor 180 will apply a torque force to the rock bolt 164 as the rock bolt 164 is being installed in the bolt hole. A bolt feed motor 168 either in the form of a hydraulic motor and matching chain or a hydraulic actuator, such as a hydraulic cylinder can be provided on the bolting portion 160 to move the rock bolt 164 vertically and insert the rock bolt 164 into the bolt hole. The bolt feed motor 168 can apply an insertion force to the rock bolt 164 to force it into the bolt hole.

To first drill a bolt hole in a roof of an underground space, the drill feed motor 149 can move the drill rod 144 upwards as the drill rotation motor 150 rotates the drill rod 144. This rotation and upwards force can cause the drill rod 144 to bore into the roof of the underground space and form the bolt hole.

With the bolt hole formed, the rock bolt 164 can be installed in the bolt hole. The bolting portion 160 can force the rock bolt 164 upwards into the bolt hole using the bolt feed motor 168 and the bolt rotation motor 180 can be used to torque the rock bolt 164 into place when the rock bolt 164 has been fully inserted into the bolt hole.

The rock bolt 164 should be torqued to a specific torque in the bolt hole. Typically, the pressure of the hydraulics being supplied to both the bolt rotation motor 180 and the bolt feed motor 168 can be limited to a set value which will limit the maximum amount of torque, which is supplied by the bolt rotation motor 180, and insertion force, which is supplied by the bolt feed motor 168, that is applied to the rock bolt 164. In this way, the rock bolt 164 will be rotated using the bolt rotation motor 180 and forced into the bolt hole using the bolt feed motor 168 until both the bolt rotation motor 180 and bolt feed motor 168 stall out. In this manner, the amount the rock bolt 164 is torqued in the bolt hole is attempted to be set by limiting the pressure of the hydraulics driving the bolt rotation motor 180.

The bolt feed motor 168 needs to apply a high insertion force to the rock bolt 164 initially to drive it into the bolt hole and hold it in place while the torque force applied to the rock bolt 164 by the bolt rotation motor 180 torques the rock bolt 164 in place. This insertion force needs to be quite large because the bolt hole is often not drilled perfectly smooth so the rock bolt 164 can get snagged on the rough edges of the bolt hole 164 if not enough insertion force is used. Additionally, the rock bolting machine 10 can install the rock bolt 164 in the bolt hole using the bolting portion 160 in under 20 seconds so the insertion force must be enough to make this happen. However, while this high insertion force is desirable initially to force and hold the rock bolt 164 in the bolt hole, it can cause problems with the torqueing of the rock bolt 164 by the bolt rotation motor 180. When the rock bolt 164 is fully inserted in the bolt hole, this high insertion force can impart an additional friction force on the rock bolt 164 and/or a load bearing plate 165 in front of the head of the rock bolt 164 because the insertion force can cause unwanted friction that can act against the torque force being supplied to the rock bolt 164 by the bolt rotation motor 180.

In operation, the rock bolting apparatus 50 can be positioned against the roof of the underground space. Once in place against the roof of the underground space, the pick 112 in the pick mast 110 can be used to hold the rock bolting apparatus 50 against the roof while the rock bolting apparatus 50 is being used to drill a bolt hole and install a rock bolt 164 in the bolt hole.

Once the rock bolting apparatus 50 is in position against the roof of the mine or other underground space, the drilling portion 140 on the drill bolt mast 130 can be used to drill a bolt hole. The drilling rod 144 can be rotated by the drill rotation motor 150 and forced upwards by the drill feed motor 149 to bore the bolt hole in the roof of the underground space.

When the bolt hole has been drilled by the drilling portion 140, the drill rod 144 can be retracted from the bolt hole it has drilled and the bolting portion 160 can then be used to install a rock bolt 164 in the bolt hole. The drill bolt mast 130 can be pivoted around pivot point 132 using actuator 134 while the pick 112 keeps the rock bolting apparatus 50 in the same position relative to the roof. When the drill bolt mast 130 has pivoted so that the rock bolt 164 is positioned under the bolt hole, the pivoting of the drill bolt mast 130 can be stopped and the drilling portion 160 of the rock bolting apparatus 50 can be used to install the rock bolt 164 in the bolt hole.

With the rock bolt 164 positioned under the bolt hole, the bolting portion 160 can move the rock bolt 164 upwards using the bolt feed motor 168 to insert it in the drilled bolt hole and the bolt rotation motor 180 can be used to rotate the rock bolt 164 and torque it to a desired torque in the bolt hole.

The drilling of the bolt hole can be controlled using the drill feed motor 149 and the drill rotation motor 150 and a number of pressure limiting values to control the hydraulic fluid being directed to the drill feed motor 149 and the drill rotation motor 150. The installation of the rock bolt 164 by the bolting portion 160 can be controlled using the bolt rotation motor 180, the bolt feed motor 168 and a number of pressure limiting valves to control the pressure of the hydraulic fluid being directed to the bolt rotation motor 180 and the bolt feed motor 168.

Figure 5:
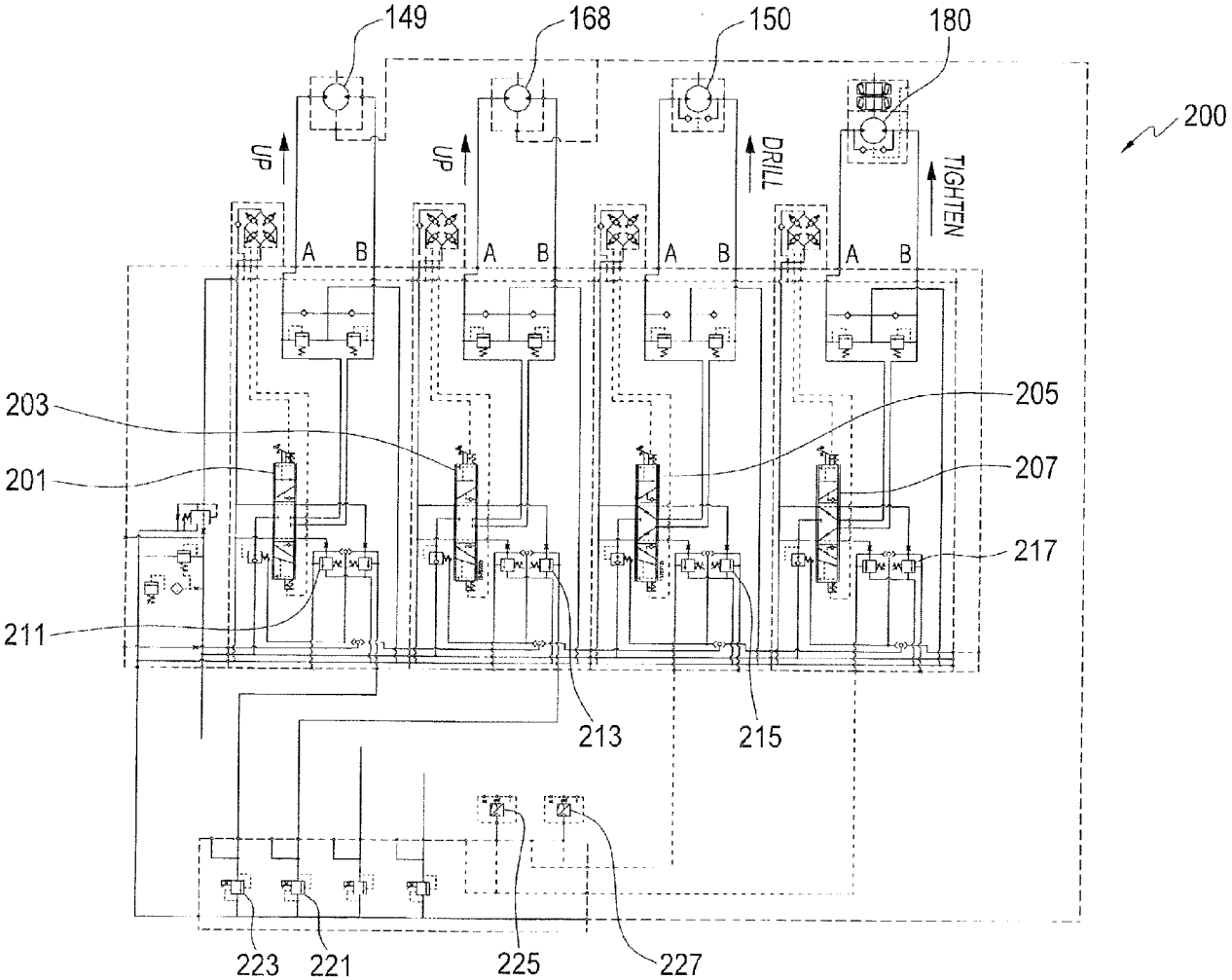
FIG. 5 is a schematic view of a controller for controlling the operation of the rock bolting machine.

FIG. 5 illustrates a controller 200 in the form of a hydraulic circuit used to control the operation of the bolting portion 160 of the rock bolting apparatus 50. The drill feed motor 149, bolt feed motor 168, drill rotation motor 150 and bolt rotation motor 180 can be supplied with hydraulic fluid using control valves 201, 203, 205 and 207, respectively. Mechanical pressure relief valves 211, 213 and 215 can be provided operatively connected with the control valves 201, 203 and 205 to limit the pressure of the hydraulic fluid that is supplied to the control valves 201, 203 and 205 and thereby the drill feed motor 149, bolt feed motor 168 and drill rotation motor 150. The pressure relief valves 201, 203 and 205 can be pre-set with upper pressure limits so that they will limit the pressure in a circuit they are connected in to this upper pressure limit.

A pressure relief valve 217 can be provided operatively connected with the control valve 207 to limit the pressure of the hydraulic fluid that is supplied to the control valve 207 and thereby the bolt rotation motor 180. The pressure relief valve 217 can control the upper pressure limit of the hydraulic fluid being supplied to the bolt rotation motor 180 preventing the pressure of the hydraulic fluid from increasing higher than this upper pressure limit. The pressure relief valve 217 can also be operable so that this upper pressure limit can be adjusted as desired. This would allow an operator in the field to set the torque to be applied to the rock bolt 164 by adjusting the upper pressure limit of the pressure relief valve 207 to the desired upper pressure limit corresponding with the desired torque so that the bolt rotation motor 180 stops rotating the rock bolt 164 when the selected upper pressure is reached.

In addition to the pressure relief valves 211, 213 and 215 and the pressure relief valve 217, a first controllable pressure relief valve 221 and a second controllable pressure relief valve 223 can be provided to further control the operation of the bolt feed motor 168 and the drill feed motor 149, respectively. The first controllable pressure relief valve 221 and the second controllable pressure relief valve 223 can be electronically controlled with the first controllable pressure relief valve 221 having a first adjustable upper pressure limit and the second controllable pressure relief valve 223 having a second adjustable upper pressure limit. The first controllable pressure relief valve 221 can be operably connected to a first pressure sensor 225 that is operatively connected to the hydraulic fluid being supplied to the control valve 207 and the bolt rotation motor 180 to limit the pressure of the hydraulic fluid to the first adjustable upper pressure limit. The first pressure sensor 225 can measure the pressure of the hydraulic fluid being supplied to the bolt rotation motor 180 and as the pressure of the hydraulic fluid increases, indicating there is more force being applied to the rock bolt 164, the first controllable pressure relief valve 221 can decrease the first adjustable upper pressure limit thereby reducing the pressure of the hydraulic fluid being supplied to the bolt feed motor 168 which will reduce the insertion force being applied to the rock bolt 164 to force the rock bolt 164 into a bolt hole that was created.

The second pressure sensor 227 can measure the pressure of the hydraulic fluid being supplied to the drill rotation motor 150 and as the pressure of the hydraulic fluid being measured increases, the second controllable pressure relief valve 223 can reduce the second adjustable upper pressure limit of the second controllable pressure relief valve 223 and thereby reduce the pressure of the hydraulic fluid being supplied to the drill feed motor 149 and thereby decrease the insertion force being applied to the drill rod 144 to force the drill rod 144 up into a roof of an underground space. During the drilling of the bolt hole, if it becomes easier to rotate the drill rod 144, the second pressure sensor 227 can measure a decrease in the pressure of the hydraulic fluid being supplied to the drill rotation motor 150 and the second controllable pressure relief valve 223 can once again increase the second adjustable upper pressure limit, thereby increasing the pressure of the hydraulic fluid being supplied to the drill feed motor 149 to once again increase the insertion force being applied to the drill rod 144 as it is rotated by the drill rotation motor 150. This can continue until the bolt hole has been drilled to the desired depth.

Unlike the drilling of the bolt hole, the rock bolt 164 is secured in place when it has been torqued to a desired torque amount. As the pressure of the hydraulic fluid being supplied to the bolt rotation motor 180 continues to increase as the rock bolt 164 gets torqued tighter and tighter, the first controllable pressure relief valve 221 can continue to decrease the first adjustable upper pressure limit and thereby decrease the pressure of the hydraulic fluid being supplied to the bolt feed motor 168 until the bolt feed motor 168 is effectively applying no insertion force to the rock bolt 164. At this point the rock bolting machine 10 is no longer forcing the rock bolt 164 up into the created bolt hole and all of the force being applied to the rock bolt 164 is rotational force being provided by the bolt rotation motor 180. This bolt rotation motor 180 can continue to supply a torque force to the rock bolt 164 until the force being applied causes the pressure being supplied to the bolt rotation motor 180 to reach the upper pressure limit of the pressure relief valve 217 and the bolt rotation motor 180 will stall out. At this point the rock bolt 164 will be installed in the bolt hole and torqued to an amount that is closer to the desired torque amount than if the rock bolt 164 had been forced both upwards by the bolt feed motor 168 and torqued by the bolt rotation motor 180 until the bolt rotation motor 180 had stalled out.

Figure 6:
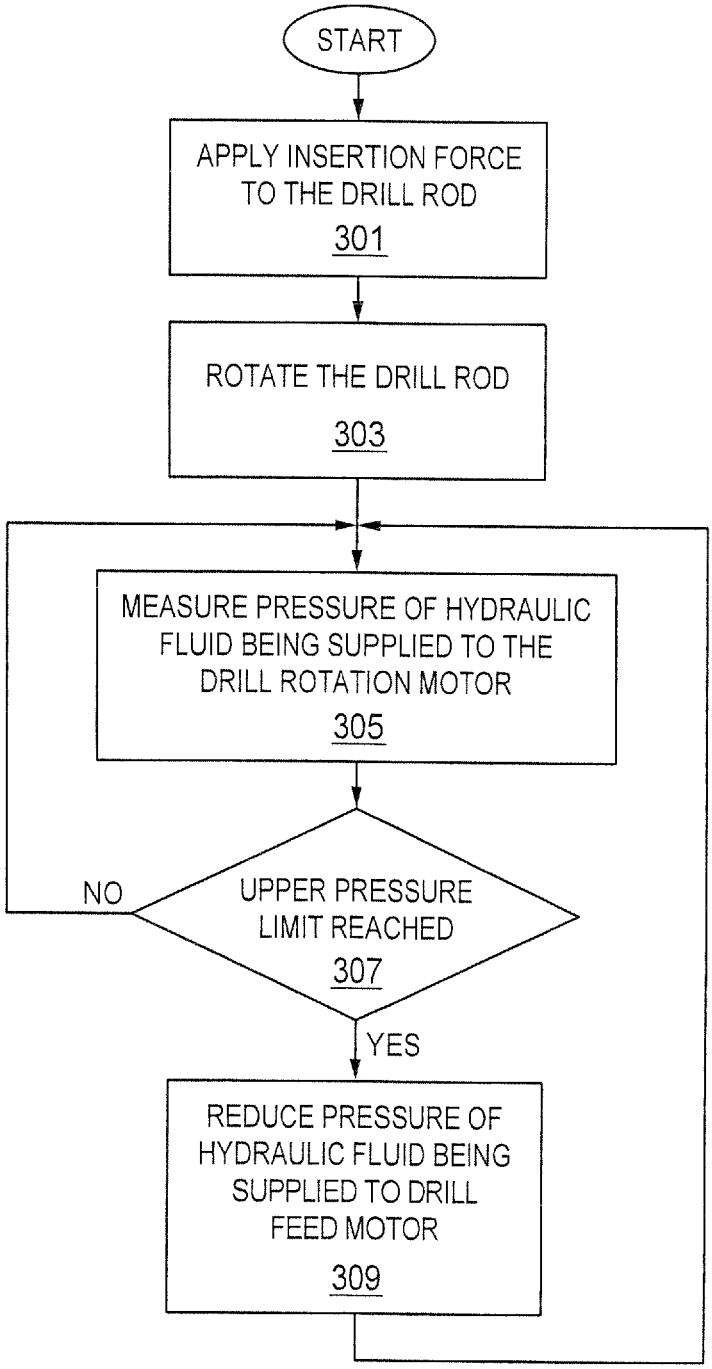
FIG. 6 is a flowchart of a method of controlling the drilling of a bolt hole.

FIG. 6 illustrates a flowchart of a method for controlling the drilling of a bolt hole in a roof of a mine or other underground space using the drilling portion 140 of the rock bolting apparatus 50. The method reduces the insertion force being applied to the drill rod 144 by the drill feed motor 149 as the torque force being applied to the drill rod 144 increases.

The method can begin and at step 301, an insertion force can be applied to the drill rod 144 by the drill feed motor 149 to force the drill rod 144 upwards against a roof of an underground space. At step 303 the drill rod 144 can be rotated by the drill rotation motor 150. This upwards force and rotational force applied to the drill rod 144 by the drill feed motor 149 and the drill rotation motor 150, respectively, can cause the drill rod 144 to bore into the roof of the underground space and form a bolt hole.

At step 305 the pressure of the hydraulic fluid being supplied to the drill rotation motor 150 can be repeatedly measured by the second pressure sensor 227 until a measured pressure reaches a drill rotational force level at step 307. When this drill rotational force level is measured at step 307, the second controllable pressure relief valve 223 can act to reduce the pressure of the hydraulic fluid being supplied to drill feed motor 149 at step 309 to reduce the insertion force being applied to the drill rod 144 by the drill feed motor 149.

Steps 305, 307 and 309 of the method can be repeated as the drill rod 144 is used to create the bolt hole. When the insertion force being applied to the drill rod 144 decreases (e.g. the drill rod 144 has made it through a particularly hard part of the rock it is drilling through) causing the pressure measured at step 305 to be below the drill rotational force level, the insertion force can be once again increased at step 309. In this manner, the method can vary the insertion force being applied to the drill rod 144 depending on the hardness of the rock being drilled through as the bolt hole is being drilled; decreasing it when the drill rod hits a harder patch and increasing it again when the harder patch is drilled through.

Figure 7:
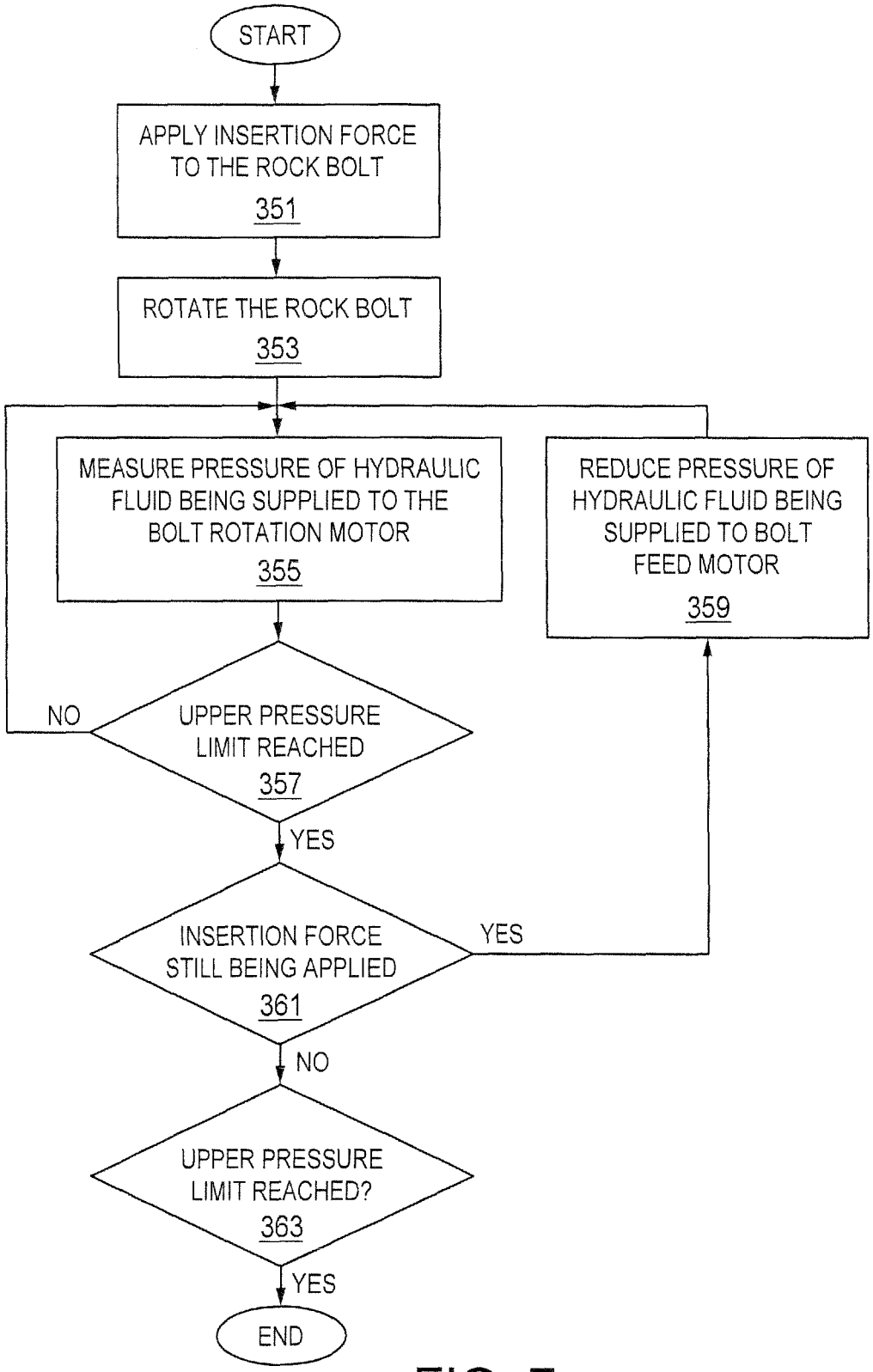
FIG. 7 is a flowchart of a method of controlling the installation of a rock bolt into a bolt hole.

FIG. 7 illustrates a flowchart of a method for installing a rock bolt 164 in the roof of a mine using the bolting portion 160 of the rock bolting apparatus 50. The method reduces the insertion force being applied to the rock bolt 164 by the bolt feed motor 168 as the torque force being applied to the rock bolt 164 by the bolt rotation motor 180 increases towards a desired torque amount. The reduction in the insertion force as the torque force increases reduces the unwanted additional friction on the rock bolt 164 that can be caused by the load bearing plate 165 and allows the torque applied to the rock bolt 164 to be closer to the ideal desired torque amount.

The method can begin and at step 351 the insertion force can be applied to the rock bolt 164 by the bolt feed motor 168 to drive the rock bolt 164 upwards and in place in the bolt hole. At step 353 torque force can be applied to the rock bolt 164 to rotate it using the bolt rotation motor 180. At this point the full insertion force and full torque force is being applied to the rock bolt 164 by the bolt feed motor 168 and bolt rotation motor 180, respectively.

At step 355 the pressure being supplied to the bolt rotation motor 180 can be monitored by being repeatedly measured by the first pressure sensor 225. Initially, the rock bolt 164 will rotate relatively easily and the pressure of the hydraulic fluid being supplied to the bolt rotation motor 180 will be relatively low. As the rock bolt 164 continues to be rotated into place in the bolt hole, the rock bolt 164 will become harder and harder to rotate and the pressure being supplied to the bolt rotation motor 180 to rotate the rock bolt 164 will increase. At step 357, as the pressure being measured by the first pressure sensor 225 increases to a bolt rotational force level, the first controllable pressure relief valve 221 can operate to lower the first adjustable upper pressure limit, decreasing the pressure of the hydraulic fluid being supplied to the bolt feed motor 168 and thereby decrease the insertion force being applied to the rock bolt 164 by the bolt feed motor 168. As this increase in pressure is repeatedly measured by the first pressure sensor 225, the first controllable pressure relief valve 221 can operate to decrease the pressure of the hydraulic fluid being supplied to the bolt feed motor 168 in relation to the increase in pressure being supplied to the bolt rotation motor 180. In one aspect, the first controllable pressure relief valve 221 can decrease the pressure of the hydraulic fluid being supplied to the bolt feed motor 168 by repeating steps 355, 357 and 359 until substantially no insertion force is being applied to the rock bolt 164 and the rock bolt 164 is only subject to torsional force by the bolt rotation motor 180.

Steps 355, 357 and 359 can be repeated with the hydraulic pressure being supplied to the bolt feed motor 168 repeatedly decreased until at step 361 the pressure of the hydraulic pressure is so low that the bolt feed motor 168 is applying substantially no insertion force on the rock bolt 164. When this occurs at step 361, the method can move onto step 363 and when the pressure of the hydraulic fluid being supplied to the bolt rotation motor 180 reaches the upper pressure limit selected on the pressure relief valve 217 to torque the rock bolt 164 to the desired torque amount, the bolt rotation motor 180 will stall out meaning the rock bolt 164 should be torqued to the desired torque amount and the method can then end.

The bolt rotational force level will be less than the desired torque amount so that the rotational forces applied to the rock bolt 164 by the bolt rotation motor 180 can continue to increase after the bolt feed motor 168 has stopped applying insertion force to the rock bolt 164 to allow the rotational force to increase to the desired torque amount after the bolt feed motor 168 has stopped applying insertion force to the rock bolt 164.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

The invention claimed is:

1. A method of installing a rock bolt, the method comprising;

applying an insertion force to the rock bolt to insert the rock bolt into a bolt hole;

while the insertion force is applied to the rock bolt, applying a rotational force on the rock bolt to rotate the rock bolt in the bolt hole; and in response to at least the rotational force being applied to the rock bolt to rotate the rock bolt increasing to a threshold amount, decreasing the insertion force applied to the rock bolt.

2. The method of claim 1 wherein the insertion force is decreased until the insertion force being applied to the rock bolt is substantially zero while the rotational force is still being applied to the rock bolt.

3. The method of claim 1 further comprising continuing to apply an increasing rotational force to the rock bolt until a desired torque amount is reached and in response to the rotational force reaching the desired torque level, stopping applying rotational force to the rock bolt.

4. The method of claim 1 wherein the bolt hole is formed by:

applying an insertion force to a drill rod;

while the insertion force is being applied to the drill rod, applying a rotational force on the drill rod to rotate the drill rod and bore the bolt hole;

when the rotational force being applied to the drill rod increases above a drill rotational force level, decreasing the insertion force applied to the drill rod; and when the rotational force being applied to the drill rod decreases below the drill rotational force level, increasing the insertion force applied to the drill rod.

5. A rock bolting apparatus for installing a rock bolt in a bolt hole, the rock bolting apparatus comprising:

a bolting portion adapted for installing the rock bolt in the bolt hole, the bolting portion comprising:

a bolt feed motor operatively connected to the rock bolt to apply an insertion force to the rock bolt to insert the rock bolt in the bolt hole;

a bolt rotation motor operatively connected to the rock bolt to apply rotational force to the rock bolt; and a controller operative to determine the rotational force being applied to the rock bolt by the bolt rotation motor and in response to determining that the rotational force being applied to the rock bolt to rotate the rock bolt has reached a threshold amount, decrease the insertion force applied to the rock bolt by the bolt feed motor.

6. The apparatus of claim 5 wherein the controller decreases the insertion force applied by the bolt feed motor until the insertion force being applied to the rock bolt by the bolt feed motor is substantially zero while the bolt rotation motor is still applying rotational force to the rock bolt.

7. The apparatus of claim 6 further comprising continuing to apply an increasing rotational force to the rock bolt until a desired torque is reached.

8. The apparatus of claim 5 wherein the bolt feed motor and the bolt rotation motor are hydraulic motors and the controller measures a pressure of hydraulic fluid supplied to the bolt rotation motor and is operative to vary a pressure of hydraulic fluid supplied to the bolt feed motor.

9. The apparatus of claim 8 wherein the controller decreases the pressure of the hydraulic fluid supplied to the bolt feed motor when the pressure of the hydraulic fluid supplied to the bolt rotation motor is above a bolt rotational force level.

10. The apparatus of claim 8 wherein the controller comprises a pressure relief valve operatively connected to the bolt rotation motor, the pressure relief valve limiting the pressure of the hydraulic fluid supplied to the bolt rotation motor and thereby setting the amount the rock bolt is torqued to by the bolt rotation motor.

11. The apparatus of claim 10 wherein the pressure relief valve is adjustable to alter the upper pressure limit of the pressure relief valve and thereby the amount the rock bolt is torqued in the bolt hole.

12. The apparatus of claim 8 further comprising a controllable pressure relief valve having an adjustable upper pressure limit, the controllable pressure relief valve operatively connected to the bolt feed motor and controllable by the controller to reduce the adjustable upper pressure limit and decrease the pressure of the hydraulic fluid supplied to the bolt feed motor.

13. The apparatus of claim 12 further comprising a pressure sensor adapted to measure the pressure of the hydraulic fluid being supplied to the bolt rotation motor, the controller adjusting the adjustable upper pressure limit of the controllable pressure relief valve based on the pressure measured by the pressure sensor.

14. The apparatus of claim 5 further comprising a drilling portion adapted for drilling the bolt hole before the drilling portion installs the rock bolt in the bolt hole.

15. The apparatus of claim 14 wherein the drilling portion comprises:

a drill feed motor operatively connected to a drill rod to apply an insertion force to the drill rod; and a drill rotation motor operatively connected to the drill to apply a rotational force to the drill rod.

16. The apparatus of claim 15 wherein the controller is further operative to:

determine the rotational force being applied to the drill rod by the drill rotation motor;

when the rotational force being applied to the drill rod increases above a drill rotational force level, decrease the insertion force applied to the drill rod by the drill feed motor; and when the rotational force being applied to the drill rod decreases below the drill rotational force level, increasing the insertion force applied to the drill rod by the drill feed motor.

17. The apparatus of claim 16 further comprising a second controllable pressure relief valve having a second adjustable upper pressure limit, the second controllable pressure relief valve operatively connected to the drill feed motor and controllable by the controller to adjust the second adjustable upper pressure limit and alter the pressure of the hydraulic fluid supplied to the drill feed motor.

18. The apparatus of claim 17 further comprising a second pressure sensor adapted to measure the pressure of the hydraulic fluid being supplied to the drill rotation motor, the controller adjusting the second adjustable upper pressure limit of the second controllable pressure relief valve based on the pressure measured by the second pressure sensor.

19. The apparatus of claim 18 wherein the second adjustable upper pressure limit of the second controllable pressure relief valve is decreased when the pressure of the hydraulic fluid being supplied to the drill rotation motor is measured above the drill rotational force level.

20. The apparatus of claim 18 wherein the second adjustable upper pressure limit of the second controllable sensor is increased when the pressure of the hydraulic fluid being supplied to the drill rotation motor is measured below the drill rotational force level.

* * * * *